US012338540B1

(12) United States Patent
Edmonston et al.

(10) Patent No.: US 12,338,540 B1
(45) Date of Patent: Jun. 24, 2025

(54) ELECTROLYZER CELL MODULE AND METHOD OF OPERATING THEREOF USING SEPARATE STACK AIR FLOW AND PRODUCT COOLING FLOW

(71) Applicant: BLOOM ENERGY CORPORATION, San Jose, CA (US)

(72) Inventors: David Edmonston, Soquel, CA (US); Jesse Doty, Santa Maria, CA (US); Alejandro Lavernia, San Jose, CA (US); David Weingaertner, Sunnyvale, CA (US); Mark Stanton, Santa Clara, CA (US); Shannon Bell, San Jose, CA (US); Jayakumar Krishnadass, Santa Clara, CA (US); Samuel Juday, Tahoe City, CA (US)

(73) Assignee: BLOOM ENERGY CORPORATION, San Jose, CA (US)

( * ) Notice: Subject to any disclaimer, the term of this patent is extended or adjusted under 35 U.S.C. 154(b) by 0 days.

(21) Appl. No.: 18/980,460

(22) Filed: Dec. 13, 2024

Related U.S. Application Data

(60) Provisional application No. 63/610,713, filed on Dec. 15, 2023.

(51) Int. Cl.

| | |
|---|---|
| ***C25B 9/67*** | (2021.01) |
| ***C25B 1/042*** | (2021.01) |
| ***C25B 9/70*** | (2021.01) |
| ***C25B 15/021*** | (2021.01) |
| ***C25B 15/023*** | (2021.01) |

(52) U.S. Cl.
CPC ..... *C25B 9/67* (2021.01); *C25B 1/042* (2021.01); *C25B 9/70* (2021.01); *C25B 15/021* (2021.01); *C25B 15/023* (2021.01)

(58) Field of Classification Search
None
See application file for complete search history.

(56) References Cited

U.S. PATENT DOCUMENTS

| | | | | |
|---|---|---|---|---|
| 8,580,456 | B2 | 11/2013 | Armstrong et al. | |
| 10,991,963 | B2 * | 4/2021 | Wang ..... | H01M 8/04686 |
| 11,322,767 | B2 * | 5/2022 | Weingaertner .... | H01M 8/04164 |

(Continued)

OTHER PUBLICATIONS

Doty, J. et al., "Electrolyzer System Including Thermal Control Components and Method of Operating Same," U.S. Appl. No. 18/597,298, filed Mar. 6, 2024.

(Continued)

*Primary Examiner* — Alexander W Keeling
(74) *Attorney, Agent, or Firm* — THE MARBURY LAW GROUP PLLC

(57) ABSTRACT

A method of operating an electrolyzer module includes providing a first air stream and steam into a stack of electrolyzer cells located in a hotbox and outputting a product stream containing hydrogen and steam, and an oxygen exhaust stream, providing the product stream to an internal product cooler (IPC) heat exchanger located in the hotbox to reduce the temperature of the product stream by transferring heat to the first air stream, and providing the product stream from the IPC to an external product cooler (EPC) heat exchanger located outside of the hotbox and inside of a cabinet housing the hotbox to further reduce the temperature of the product stream by transferring heat to a fluid stream.

20 Claims, 11 Drawing Sheets

(56) References Cited

U.S. PATENT DOCUMENTS

| | | | | |
|---|---|---|---|---|
| 12,040,520 | B2 | 7/2024 | Mahler et al. | |
| 2010/0062298 | A1* | 3/2010 | Valensa | H01M 8/2475 429/425 |
| 2020/0099084 | A1* | 3/2020 | Onuma | H01M 8/04029 |
| 2022/0372636 | A1* | 11/2022 | Weingaertner | F22D 1/12 |
| 2023/0013942 | A1 | 1/2023 | Weingaertner et al. | |
| 2024/0368774 | A1 | 11/2024 | Lavernia et al. | |

OTHER PUBLICATIONS

Lu, Z. et al., "Internally Manifolded Interconnects with Plural Flow Directions and Electrochemical Cell Column Including Same," U.S. Appl. No. 63/598,678, filed Nov. 14, 2023.

* cited by examiner

ELECTROLYZER CELL MODULE AND METHOD OF OPERATING THEREOF USING SEPARATE STACK AIR FLOW AND PRODUCT COOLING FLOW

FIELD

The embodiments of the present invention generally relate to electrolyzer cell systems that provide a heated air stream for electrolyzer cell stack operation and a separate fluid stream for cooling a hydrogen product generated by the stack.

BACKGROUND

In a solid oxide electrolyzer cell (SOEC), a cathode electrode is separated from an anode electrode by a solid oxide electrolyte. When a SOEC is used to produce hydrogen through electrolysis, a positive potential is applied to the air side of the SOEC and oxygen ions are transported from the fuel (e.g., steam) side to the air side. Throughout this specification, the SOEC anode will be referred to as the air electrode, and the SOEC cathode will be referred to as the fuel electrode. During SOEC operation, water (e.g., steam) in the fuel stream is reduced ($H_2O+2e^- \rightarrow O^{2-}+H_2$) to form $H_2$ gas and $O^{2-}$ ions, the $O^{2-}$ ions are transported through the solid electrolyte, and then oxidized (e.g., by an air inlet stream) on the air side ($O^{2-}$ to $O_2$) to produce molecular oxygen (e.g., oxygen enriched air).

SUMMARY

According to various embodiments, an electrolyzer module comprises a cabinet, a hotbox located in the cabinet, a stack of electrolyzer cells located in the hotbox and configured receive a first air stream and steam, and output a product stream comprising hydrogen and steam, and an oxygen exhaust stream; an internal product cooler (IPC) heat exchanger located in the hotbox and configured to reduce the temperature of the product stream by transferring heat to the first air stream; an external product cooler (EPC) heat exchanger located outside of the hotbox and inside of the cabinet, and configured to further reduce the temperature of the product stream by transferring heat to a fluid stream; and a main air blower configured to generate the first air stream.

According to various embodiments, a method of operating an electrolyzer module comprises: providing a first air stream and steam into a stack of electrolyzer cells located in a hotbox and outputting a product stream comprising hydrogen and steam, and an oxygen exhaust stream; providing the product stream to an internal product cooler (IPC) heat exchanger located in the hotbox to reduce the temperature of the product stream by transferring heat to the first air stream; and providing the product stream from the IPC to an external product cooler (EPC) heat exchanger located outside of the hotbox to further reduce the temperature of the product stream by transferring heat to a fluid stream.

According to various embodiments, an electrolyzer module comprises a hotbox; a stack of electrolyzer cells located in the hotbox and configured receive a first air stream and steam, and output a product stream comprising hydrogen and steam, and an oxygen exhaust stream; a main air blower configured to generate the first air stream; a first air conduit assembly fluidly connecting the main air blower to the stack; a cooling air blower configured to generate a second air stream; an external product cooler (EPC) heat exchanger located outside of the hotbox and inside of a cabinet housing the hotbox and configured reduce a temperature of the product stream by transferring heat to the second air stream; and a second air conduit assembly fluidly connecting the cooling air blower to the EPC.

DETAILED DESCRIPTION

Figure 1A:
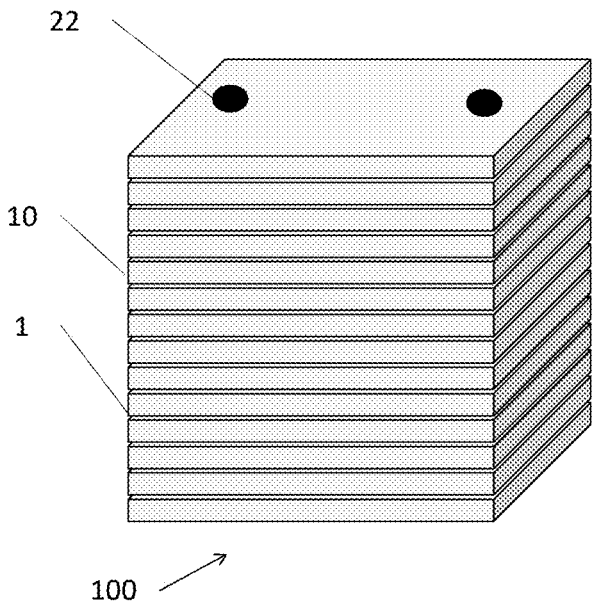
FIG. 1A is a perspective view of a solid oxide electrolyzer cell (SOEC) stack.

As set forth herein, various aspects of the disclosure are described with reference to the exemplary embodiments and/or the accompanying drawings in which exemplary embodiments of the invention are illustrated. This invention may, however, be embodied in many different forms and should not be construed as limited to the exemplary embodiments shown in the drawings or described herein. It will be appreciated that the various disclosed embodiments may involve particular features, elements or steps that are described in connection with that particular embodiment. It will also be appreciated that a particular feature, element or step, although described in relation to one particular embodiment, may be interchanged or combined with alternate embodiments in various non-illustrated combinations or permutations.

Ranges can be expressed herein as from "about" one particular value, and/or to "about" another particular value. When such a range is expressed, examples include from the one particular value and/or to the other particular value. Similarly, when values are expressed as approximations, by use of the antecedent "about" or "substantially," it will be understood that the particular value forms another aspect. In some embodiments, a value of "about X" may include values of +/−1% X. It will be further understood that the endpoints of each of the ranges are significant both in relation to the other endpoint, and independently of the other endpoint.

Figure 1B:
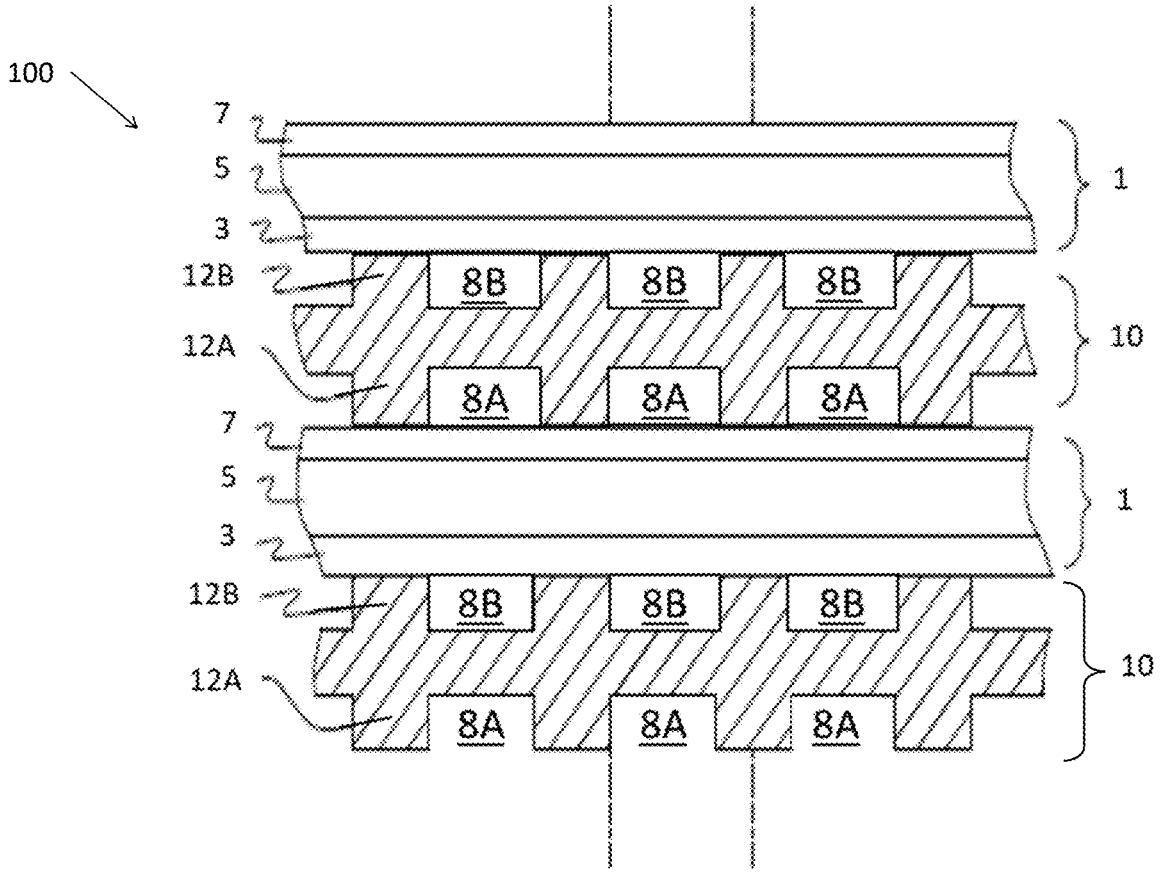
FIG. 1B is a side cross-sectional view of a portion of the stack of FIG. 1A.

FIG. 1A is a perspective view of an electrolyzer cell stack 100, such as a solid oxide electrolyzer cell (SOEC) stack, and FIG. 1B is a side cross-sectional view of a portion of the stack 100 of FIG. 1A. Referring to FIGS. 1A and 1B, the stack 100 includes multiple electrolyzer cells (e.g., SOECs) 1 that are separated by interconnects 10, which may also be referred to as gas flow separator plates or bipolar plates. Each electrolyzer cell 1 includes an air electrode 3, an electrolyte 5, such as a solid oxide electrolyte for a SOEC, and a fuel electrode 7. The stack 100 also includes internal fuel riser channels 22.

Each interconnect 10 electrically connects adjacent electrolyzer cells 1 in the stack 100. In particular, an interconnect 10 may electrically connect the fuel electrode 7 of one electrolyzer cell 1 to the air electrode 3 of an adjacent electrolyzer cell 1. FIG. 1B shows that the lower electrolyzer cell 1 is located between two interconnects 10.

Various materials may be used for the air electrode 3, electrolyte 5, and fuel electrode 7. For example, the air electrode 3 may comprise an electrically conductive material, such as an electrically conductive perovskite material, such as lanthanum strontium manganite (LSM). Other conductive perovskites, such as LSCo, etc., or metals, such as Pt, may also be used. The electrolyte 5 may comprise a stabilized zirconia, such as scandia stabilized zirconia (SSZ) or yttria stabilized zirconia (YSZ), yttria-ceria-stabilized zirconia (YCSZ), ytterbia-ceria-scandia-stabilized zirconia (YbCSSZ) or blends thereof. In YbCSSZ, scandia may be present in an amount equal to 9 to 11 mol %, such as 10 mol %, ceria may present in amount greater than 0 and equal to or less than 3 mol %, for example 0.5 mol % to 2.5 mol %, such as 1 mol %, and ytterbia may be present in an amount greater than 0 and equal to or less than 2.5 mol %, for example 0.5 mol % to 2 mol %, such as 1 mol %, as disclosed in U.S. Pat. No. 8,580,456, which is incorporated herein by reference. Alternatively, the electrolyte 5 may comprise another ionically conductive material, such as a doped ceria. The fuel electrode 7 may comprise a cermet comprising a nickel containing phase and a ceramic phase. The nickel containing phase may consist entirely of nickel in a reduced state. The ceramic phase may comprise a stabilized zirconia, such as yttria and/or scandia stabilized zirconia and/or a doped ceria, such as gadolinia, yttria and/or samaria doped ceria. The electrodes and the electrolyte may each comprise one or more sublayers of one or more of the above described materials.

Each interconnect 10 includes fuel ribs 12A that at least partially define fuel channels 8A, and air ribs 12B that at least partially define air channels 8B. The interconnect 10 may operate as a gas-fuel separator that separates a fuel, such as steam, flowing to the fuel electrode 7 of one electrolyzer cell 1 in the stack 100 from oxidant, such as air, flowing to the air electrode 3 of an adjacent electrolyzer cell 1 in the stack 100. At either end of the stack 100, there may be an air end plate or fuel end plate (not shown) for providing air or fuel, respectively, to the end electrode. Alternatively, the air end plate or fuel end plate may comprise the same interconnect structure used throughout the stack.

Each interconnect 10 may be made of or may contain electrically conductive material, such as a metal alloy (e.g., chromium-iron alloy) which has a similar coefficient of thermal expansion to that of the solid oxide electrolyte in the cells (e.g., a difference of 0-10%). For example, the interconnects 10 may comprise a metal (e.g., a chromium-iron alloy, such as 4-6 weight percent iron, optionally 1 or less weight percent yttrium and balance chromium alloy). Alternatively, any other suitable conductive interconnect material, such as stainless steel (e.g., ferritic stainless steel, SS446, SS430, etc.) or iron-chromium alloy (e.g., Crofer™ 22 APU alloy which contains 20 to 24 wt. % Cr, less than 1 wt. % Mn, Ti and La, and balance Fe, or ZMG™ 232L alloy which contains 21 to 23 wt. % Cr, 1 wt. % Mn and less than 1 wt. % Si, C, Ni, Al, Zr and La, and balance Fe) may be used.

A comparative embodiment electrolyzer module uses incoming air (i.e., the air inlet stream) for both cooling the steam-recycle loop (i.e., the hydrogen product stream output from the stack 100 and the steam-hydrogen mixture that is output from the stack 100 and then recycled back into the steam inlet stream provided into the stack 100), as well as diluting the oxygen enriched air stream (i.e., the oxygen exhaust stream) that is output from the stack 100 inside a hotbox. This coupling may not be the most efficient way operate the electrolyzer module. For example, if dilution requirements are low, then the air flow will be dictated by the cooling required for the steam-recycle loop. This unnecessarily pulls more heat out of the hotbox, requiring more power from the heaters, which requires additional electric power usage. Alternatively, if the dilution requirements are high, condensation of the steam is possible.

The embodiments of the present disclosure decouple the cooling the steam-recycle loop from diluting the oxygen enriched air stream, and provide the ability to independently control the stack product exhaust stream cooling and the stack oxygen exhaust stream dilution.

Figure 2:
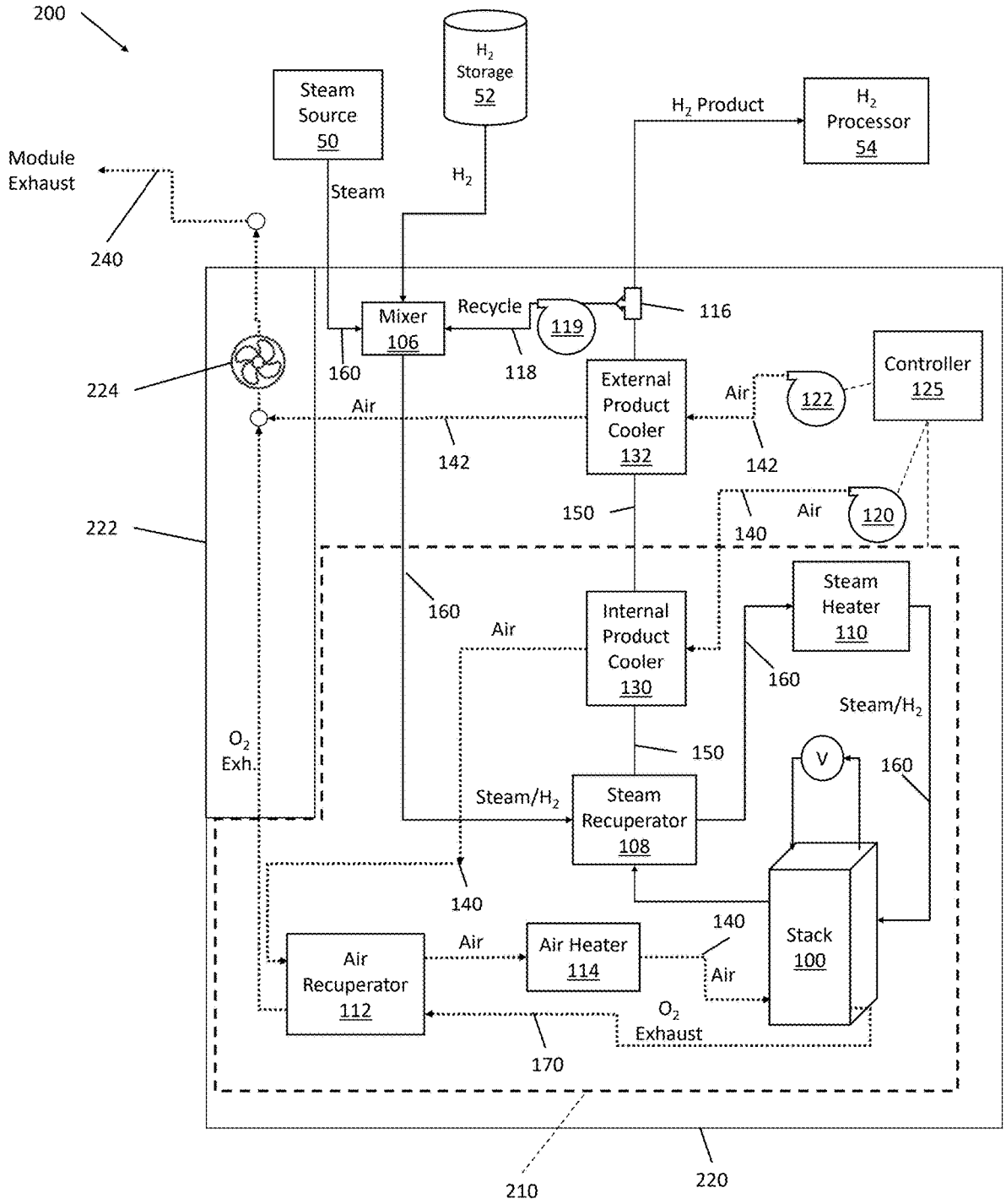
FIG. 2 is a schematic view of an electrolyzer module, according to an embodiment of the present disclosure.

FIG. 2 is a schematic view of an electrolyzer module 200, according to various embodiments of the present disclosure. Referring to FIGS. 1A, 1B, and 2, the module 200 may include one or more electrolyzer cell stacks 100 or columns, such as SOEC stacks or columns. Each column may include one or more electrolyzer cell stacks 100. The electrolyzer cell stack 100 includes multiple electrolyzer cells, such as SOECs, as described with respect to FIGS. 1A and 1B. The module 200 may also include a steam recuperator heat exchanger 108, a steam heater 110, an air recuperator heat exchanger 112, an air heater 114, and an optional mixer 106. Additional heaters, such as stack heaters, may optionally be included in the module.

The module 200 may include a hotbox 210 and a cabinet 220 housing the hotbox 210. Various components, such as the stack 100, steam recuperator 108, steam heater 110, air recuperator 112, and/or air heater 114 may be located within the hotbox 210. In some embodiments, the hotbox 210 may include multiple stacks 100 or stack columns. A ventilation unit 222 may be located in or on the cabinet 220 and may be configured to receive an oxygen-rich exhaust stream (e.g., the oxygen exhaust stream) output from the at least one stack 100 via an air exhaust conduit 170 and cabinet air output from the cabinet 220. In some embodiments, the ventilation unit 222 may include at least one fan 224 to output the electrolyzer module exhaust, including a mixture of the oxygen exhaust stream and the cabinet exhaust, to a module exhaust conduit 240. In various embodiments, the module exhaust conduit 240 may be connected to the ventilation units 222 of multiple modules 200.

During operation, the stack 100 may be provided with steam (i.e., steam inlet stream) from a steam source 50 via a steam conduit 160, and electric power (e.g., current or voltage) from an external power source. In particular, the steam may be provided to the fuel electrodes 7 of the electrolyzer cells 1 of the stack 100, and the power source may apply a voltage between the fuel electrodes 7 and the air electrodes 3, in order to electrochemically split water (i.e., steam) molecules and generate hydrogen (e.g., $H_2$) and oxygen (e.g., $O_2$). Air may also be provided to the air electrodes 3, in order to sweep the oxygen from the air electrodes 3. As such, the stack 100 may output a hydrogen product stream (e.g., a product stream comprising hydrogen ($H_2$) and steam), and an oxygen exhaust stream (e.g., oxygen enriched exhaust stream).

The steam source 50 may comprise any suitable source of steam, such as a building or factory steam source (e.g., external boiler, etc.), which provides byproduct steam to the electrolyzer module 200, or a dedicated steam generator. The steam output from the steam source 50 may be provided via the steam conduit 160 to the steam recuperator 108. However, if the module 200 includes the optional mixer 106, the steam may be provided to the mixer 106 prior to being provided to the steam recuperator 108. In particular, the steam may include small amounts of dissolved air and/or oxygen. As such, the mixer 106 may be configured to mix the steam with hydrogen gas, in order to maintain a reducing environment in the stack 100, and in particular, at the fuel electrodes 7.

The mixer 106 may be configured to mix the steam with hydrogen received from a hydrogen storage device (e.g., hydrogen storage vessel) 52 and/or with a portion of the hydrogen and steam recycle stream output from the stack 100. The hydrogen addition rate may be set to provide an amount of hydrogen that exceeds an amount of hydrogen needed to react with an amount of oxygen dissolved in the steam. The hydrogen addition rate may either be fixed or set to a constant water to hydrogen ratio. However, if the steam is formed using water that is fully deaerated, the mixer 106 and/or hydrogen addition into the steam inlet stream may optionally be omitted.

In some embodiments, the hydrogen may be provided from the hydrogen storage device 52 during module startup and shutdown modes, and optionally during steady-state operating mode. For example, during the startup and shutdown modes (or other modes where the system 200 is not generating hydrogen, such as a fault mode), the hydrogen may be provided from the hydrogen storage device 52 to the mixer 106. During the steady-state operating mode, the hydrogen flow from the hydrogen storage device 52 may be stopped. Instead, a first portion of a hydrogen exhaust stream (e.g., the hydrogen and steam product steam) generated by the stack 100 is diverted to the mixer 106 through the hydrogen recycle conduit 118 by a recycle blower 119. In particular, the module 200 may include a hydrogen separator 116, such as a splitter and/or valve, configured to selectively divert the first portion of the generated hydrogen product stream to the mixer 106 via a recycling conduit 118 during the steady-state operating mode.

The steam recuperator 108 may be a heat exchanger configured to recover heat from the hydrogen product stream (e.g., hydrogen and steam) output from the stack 100. As such, the steam recuperator 108 may be configured to increase the efficiency of the module 200. The steam may be heated to at least 600° C., such as 620° C. to 780° C. in the steam recuperator 108.

The steam output from the steam recuperator 108 may be provided to the steam heater 110 which is located downstream from the steam recuperator 108 on the steam conduit 160. The steam heater 110 may include a heating element, such as a resistive or inductive heating element. The steam heater 110 may be configured to heat the steam to a temperature above the operating temperature of the stack 100. For example, depending on the health of the stack 100, the water utilization rate of the stack 100, and the air flow rate to the stack 100, the steam heater 110 may heat the steam to a temperature ranging from about 700° C. to about 850° C., such as 720° C. to 780° C. Accordingly, the stack 100 may be provided with steam or a steam-hydrogen mixture at a temperature that allows for efficient hydrogen generation. Heat may also be transported directly from the steam heater to the stack by radiation (i.e., by radiant heat transfer). If the stack operating current is sufficiently high to maintain the stack at a desired steady-state operating temperature, then the steam heater 110 and/or the air heater 114 may be turned off. In some embodiments, the steam heater 110 may include multiple steam heater zones with independent power levels (divided vertically, circumferentially or both), in order to enhance thermal uniformity.

The oxygen exhaust stream may be output from the stack 100 and provided to the air recuperator 112 via the air exhaust conduit 170. The air recuperator 112 may also be provided with ambient air (i.e., hotbox air inlet stream) from a main air blower 120. In particular, air from the main air blower 120 may be provided to the air recuperator 112, the air heater 114, and the stack 100 via a first air conduit assembly 140 comprising at least one air conduit. The air recuperator 112 may be configured to heat the air using heat extracted from the oxygen exhaust stream. In some embodiments, the ambient air may be filtered to remove contaminants, prior to being provided to the air recuperator 112 or the main air blower 120. The oxygen exhaust output from the air recuperator 112 may be exhausted from the hotbox 210 via the air exhaust conduit 170 and provided to the module exhaust conduit 240 via the ventilation unit 222.

Heated air output from the air recuperator 112 may be provided to the air heater 114. The air heater 114 may include a resistive or inductive heating element configured to heat the air to a temperature exceeding the operating temperature of the stack 100. For example, depending on the health of the stack 100, the water utilization rate of the stack 100, and the air flow rate to the stack 100, the air heater 114 may heat the air to a temperature ranging from about 700° C. to about 850° C., such as 720° C. to 880° C. Accordingly, the stack 100 may be provided with air at a temperature that allows for efficient hydrogen generation. Heat may also be transported directly from the air heater 114 to the stack 100 by radiation. The heated air may dilute the oxygen exhaust stream generated in the stack 100 and thereby provide the oxygen enriched air stream (i.e., the oxygen exhaust stream).

The air heater 114 may include multiple air heater zones with independent power levels (divided vertically, circumferentially or both), in order to enhance thermal uniformity, in some embodiments. Air from the air heater 114 is provided to the air electrodes 3 of the stack 100, in order to remove oxygen generated during operation of the stack 100.

According to various embodiments, the module 200 may include a controller 125, such as a central processing unit, which is configured to control the operation of the module 200. For example, the controller 125 may be wired or wirelessly connected to various elements of the module 200 to control the same.

According to various embodiments, the system may include an internal product cooler (IPC) heat exchanger 130, an external product cooler (EPC) heat exchanger 132, and a cooling air blower 122. The IPC 130 may be located inside of the hotbox 210 and may be configured to receive the hydrogen product stream output from the steam recuperator 108 and air output from the main air blower 120 via the first air conduit assembly 140. In some embodiments, the hydrogen product may be output from the steam recuperator 108 at a temperature ranging from about 300° C. to about 350° C., such as from about 310° C. to about 340° C.

The IPC 130 may be configured to cool the received hydrogen product using air provided by the main air blower 120. Accordingly, the IPC 130 may be configured to preheat air provided to the air recuperator 112 by extracting heat from the hydrogen product stream output from the steam recuperator 108. In various embodiments, the IPC 130 may be configured to cool the hydrogen product to a temperature ranging from about 120° C. to about 250° C., such as from about 150° C. to about 220° C.

The EPC 132 may be located outside of the hotbox 210 and may be configured to further cool the hydrogen product output from the IPC 130, using air provided by the cooling air blower 122. For example, the EPC 132 may be located within the cabinet 220, as shown in FIG. 2. In the alternative, the EPC 132 may be located outside of the cabinet 220 or within the ventilation unit 222.

The EPC 132 may be fluidly connected to the cooling air blower 122 and the ventilation unit 222 via a second air conduit assembly 142. The stack 100, steam recuperator 108, the IPC 130, the EPC 132 and the hydrogen processor 54 may be fluidly connected by a product conduit assembly 150. The hydrogen processor 54 may comprise any component which may compress and/or store the hydrogen product, such as a mechanical compressor, an electrochemical hydrogen separator (e.g., a proton exchange membrane), etc.

In various embodiments, the EPC 132 may be configured to cool the hydrogen product to a temperature that reduces and/or prevents damage to the hydrogen processor 54 and the recycle blower 119, which are fluidly connected to the product conduit assembly 150 downstream of the EPC 132. For example, the IPC 130 and/or the EPC 132 may be configured to cool the hydrogen product to a temperature below 200° C., such as a temperature ranging from about 40° C. to about 180° C., such as from about 90° C. to about 140° C., in order to protect components of the to the hydrogen processor 54 and the recycle blower 119 from thermal damage. Air output from the EPC 132 may be provided to the ventilation unit 222 by the second air conduit assembly 142 and mixed with the oxygen exhaust stream from the air exhaust conduit 170 to generate module exhaust stream that is provided to the module exhaust conduit 240.

The EPC 132 may be any suitable type of heat exchanger configured to transfer heat from the hydrogen product to a fluid such as air or a cooling liquid (e.g., water). For example, as will be described in more detail with respect to FIGS. 11A-11E below, the EPC 132 may be a brazed plate heat exchanger, a shell and tube heat exchanger, a radiator heat exchanger, a finned tube heat exchanger, a finned tube clamp heat exchanger, or the like.

Accordingly, the module 200 may be configured to utilize first and second air streams. The first air stream from the main air blower 120 may be heated by the IPC 130, the air recuperator 112, and the air heater 114, before being provided to the stack 100 for the removal of the generated oxygen exhaust stream. The second air stream from the cooling air blower 122 may be used to extract heat from the hydrogen product in the EPC 132, before being provided to the ventilation unit 222.

A first portion of the product stream output from the EPC 132 is provided to the hydrogen processor 54 via product conduit assembly 150. The hydrogen separator 116 is configured to divert a second portion of the product stream output from the EPC 132 into the recycle conduit 118. The recycle conduit 118 is fluidly connected to the hydrogen separator 116. The recycle blower 119 is located on the recycle conduit 118 and is configured to provide the second portion of the product stream from the hydrogen separator 116 through the recycle conduit 118 into the stack 100 (via the mixer 106).

The controller 125 may be configured to independently control the operation of the hotbox and the air blowers 120, 122, in order to independently control the flow rates of the first and second air streams. For example, the speed of the main air blower 120 may be controlled based on the air requirements of the stack 100 (e.g., based on stack oxygen exhaust generation that needs to be swept out of the module 200), and the speed of the cooling air blower 122 may be controlled based on a desired temperature of the hydrogen product output from the EPC 132. As such, the module 200 may be configured to prevent excess cooling of the stack 100, which may reduce module efficiency, and may also be configured to prevent excessive cooling of the hydrogen product, which may result in unwanted condensation. Similarly, the module 200 may be configured to prevent excessive oxygen accumulation in the stack 100 and may prevent damage to the hydrogen processor 54 and/or the recycle blower 119 due to high hydrogen product temperatures.

In contrast, the comparative example electrolyzer module utilizes a single air stream for both removing oxygen from an electrolyzer stack and cooling of a hydrogen product. In such modules, high stack air requirements may result in excessive cooling of the hydrogen product, which may result in unwanted water condensation in hydrogen product conduit assemblies. In addition, high hydrogen product cooling requirements may result in high cooling air flow, which may lead to excessive stack cooling, which may reduce system efficiency. For example, a higher amount of electrical power may be required to be provided to the air heater to increase the temperature of the air provided to the stack, in order to offset the excess stack cooling due to the high air flow rate.

Figure 3:
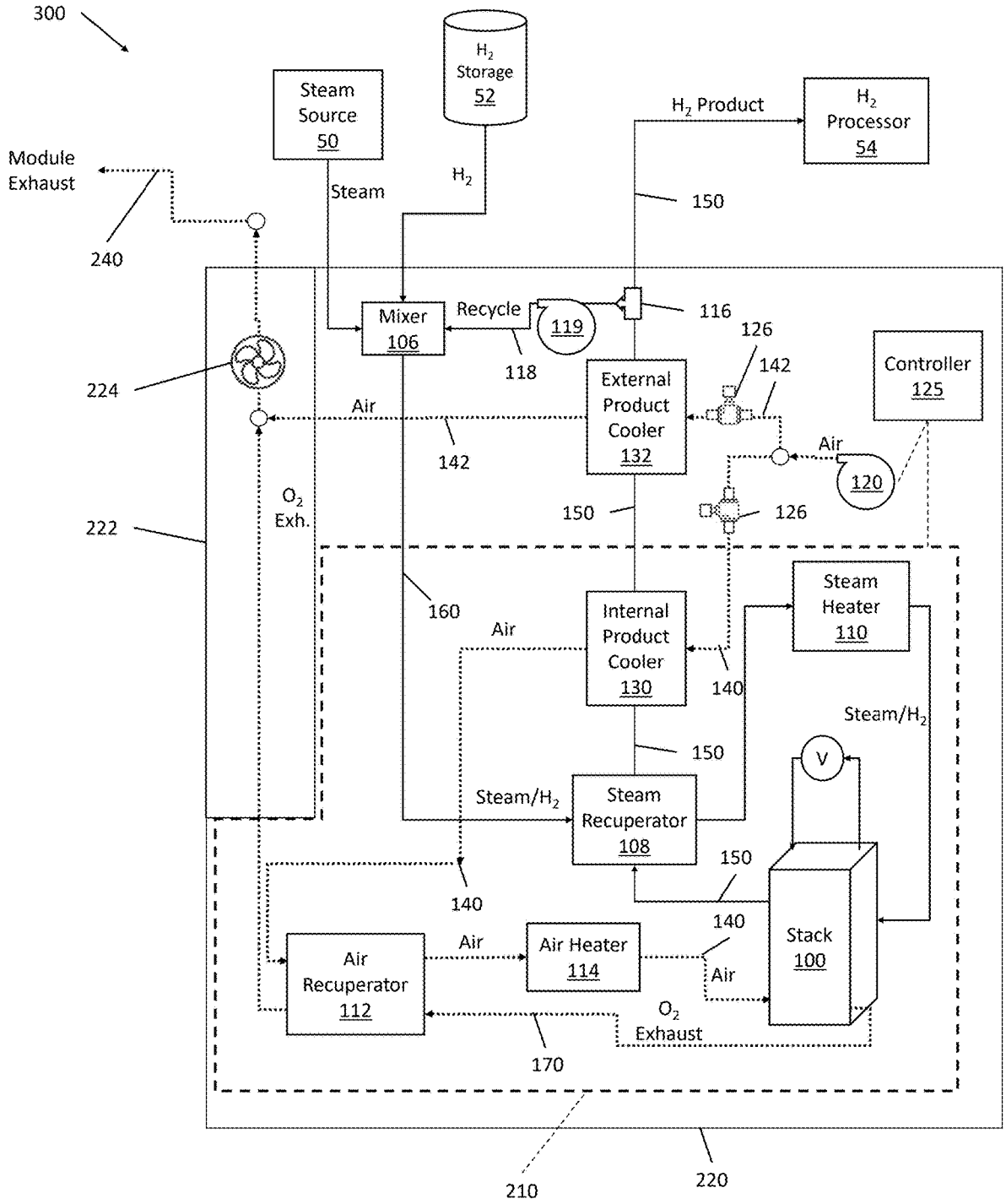
FIGS. 3-10 are schematic views of alternative electrolyzer modules, according to alternative embodiments of the present disclosure.

FIG. 3 is a schematic view of an electrolyzer module 300, according to various embodiments of the present disclosure. The module 300 may be similar to the module 200. As such, only the differences therebetween will be discussed in detail.

Referring to FIG. 3, the cooling air blower 122 may be omitted, and the first air conduit assembly 140 and the second air conduit assembly 142 may be fluidly connected to the same main air blower 120. As such, air output from the main air blower 120 may be divided into a first air stream that flows through the first air conduit assembly 140 to the stack 100, and a second air stream that flows through the second air conduit assembly 142 to the EPC 132. The module 300 may include at least one air valve 126, such as a 2-way proportionate valve, located downstream of the main air blower 120. The at least one valve 126 is configured to control air flow through the first and second air conduit assemblies 140, 142. For example, the air valve 126 may be located on the first air conduit assembly 140 and/or on the second air conduit assembly 142 to control air flow through both assemblies. In an alternative embodiment, air valves 126 may be located on both the first air conduit assembly 140 and on the second air conduit assembly 142. In another alternative embodiment, a single three-way valve (not shown) may be located at the junction of the air conduit assemblies 140, 142 to control the flow rates of the first and second air streams. As such, the flow rates of the first and second air streams may be individually controlled.

Figure 4:
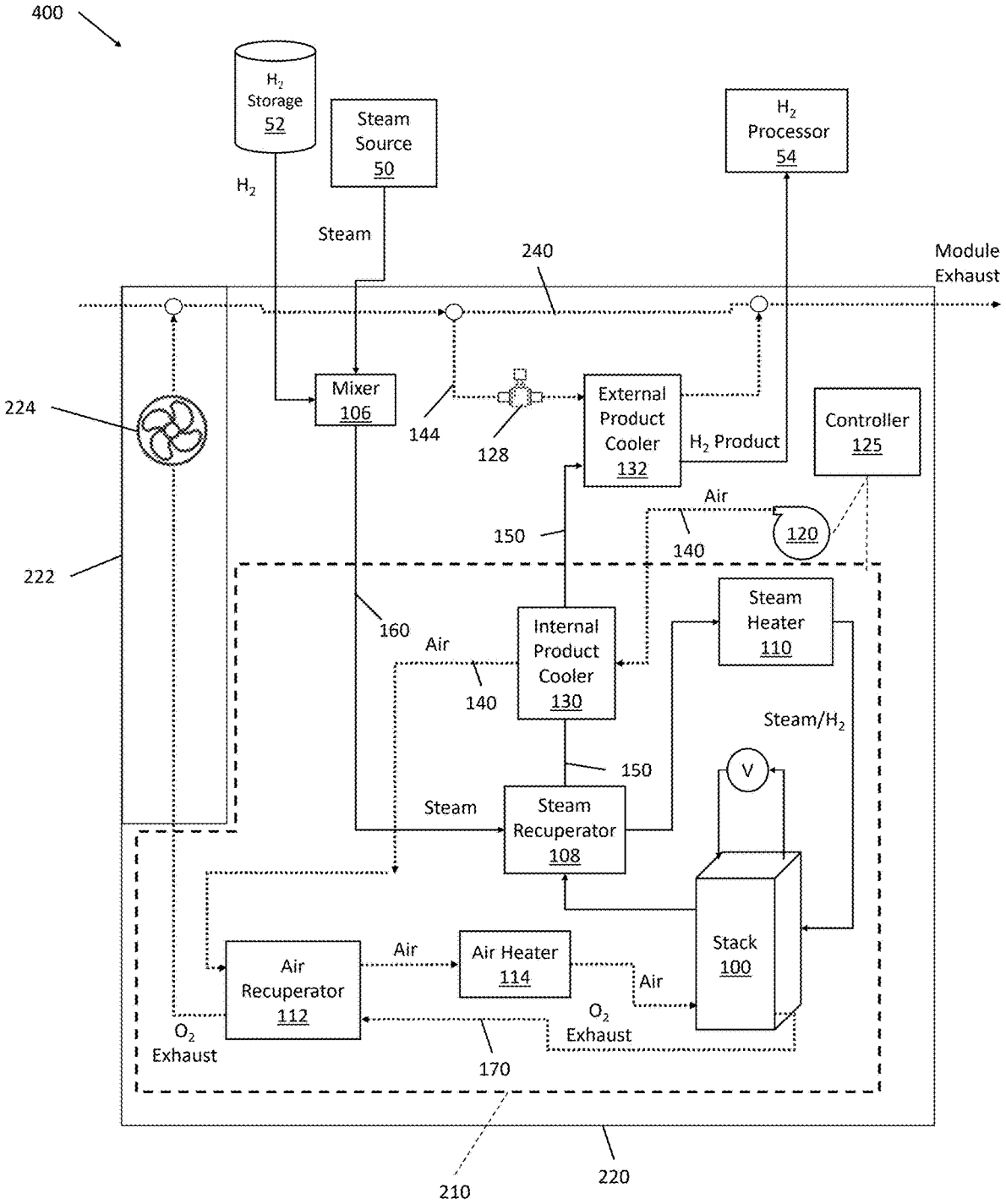

FIG. 4 is a schematic view of an electrolyzer module 400, according to various embodiments of the present disclosure. The module 400 may be similar to the module 300. As such, only the differences therebetween will be discussed in detail.

Referring to FIG. 4, the module 400 may include an exhaust diversion conduit 144 that fluidly connects the EPC 132 to the module exhaust conduit 240. The first end of the exhaust diversion conduit 144 may split off from the module exhaust conduit 240 and the second end of the exhaust diversion conduit 144 may terminate on the module exhaust conduit 240. An air valve 128, such as a proportionate valve, may be located on the diversion conduit 144. The air valve 128 is configured to control the flow rate of a portion of the module exhaust stream from the module exhaust conduit 240, through the diversion conduit 144 and the EPC 132 and back to the module exhaust conduit 240.

In this embodiment, the hydrogen separator 116, the recycling conduit 118 and the recycle blower 119 may optionally be omitted. If the hydrogen product is not recycled by a relatively low temperature tolerant recycle blower 119, the hydrogen product may be output at a higher temperature that is at or below the hydrogen processor 54 temperature rating. Accordingly, the higher temperature module exhaust stream which is warmer than ambient air may be provided to the EPC 132. Even though the module exhaust stream may be above ambient temperature, it can still be used to cool the hydrogen product stream inside the EPC 132 in a relatively narrow operating window in case the hydrogen product stream enters the EPC 132 at a higher temperature than the module exhaust stream. A relatively higher temperature hydrogen product may be provided from the EPC 132 to the hydrogen processor 54 if the hydrogen processor 54 has a higher temperature rating than the recycle blower 119. The module exhaust output from the EPC 132 may be returned to the module exhaust conduit 240 by the diversion conduit 144.

Figure 5:
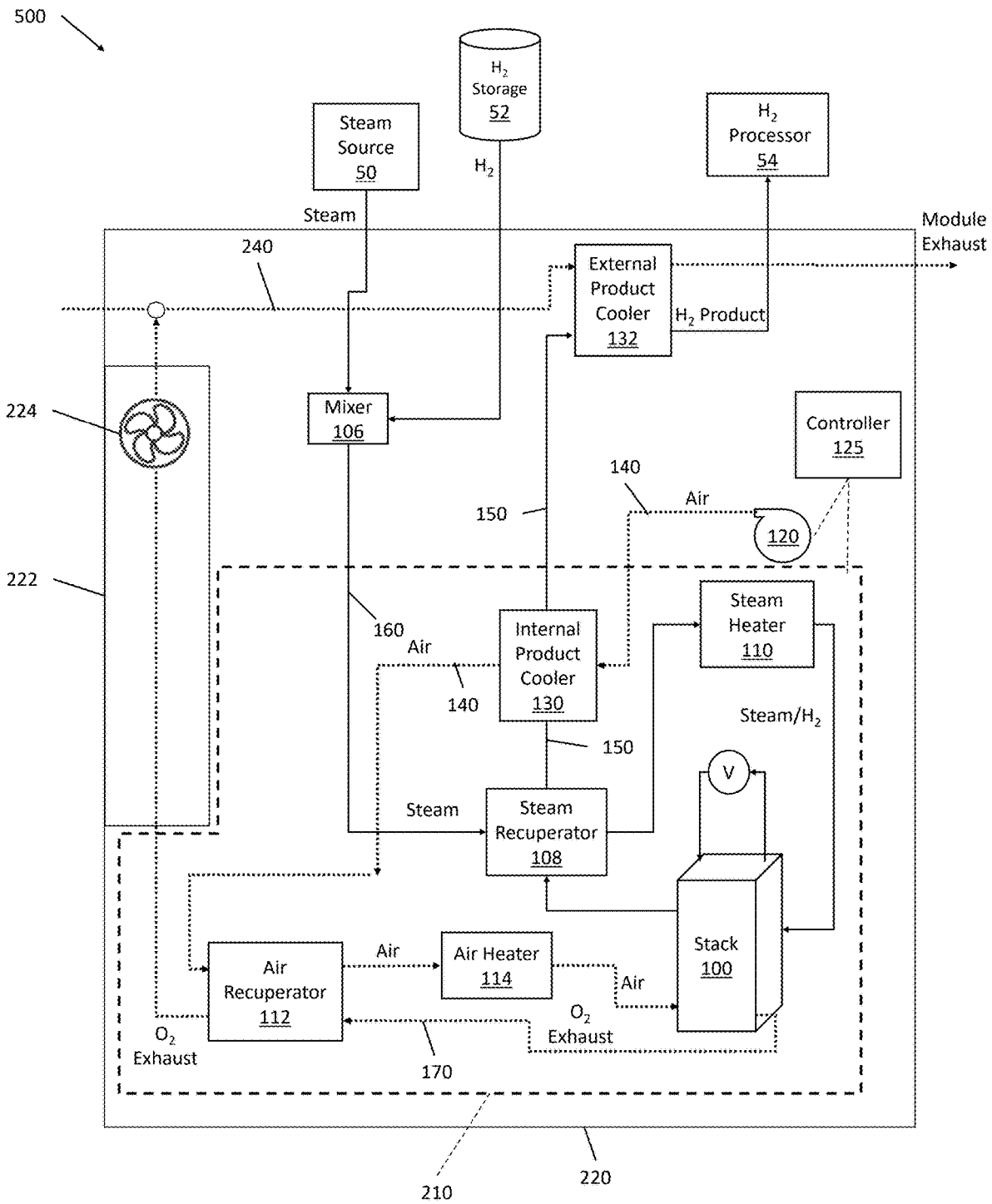

FIG. 5 is a schematic view of an electrolyzer module 500, according to various embodiments of the present disclosure. The module 500 may be similar to the module 400. As such, only the differences therebetween will be discussed in detail.

Referring to FIG. 5, the module 500 may also optionally omit the hydrogen separator 116, the recycling conduit 118 and the recycle blower 119 of the module 300. The module 500 may also omit diversion conduit 144 and the air valve 128 of the module 400.

The EPC 132 may be fluidly connected directly to the module exhaust conduit 240, such that the entire module exhaust stream passes through the EPC 132. Accordingly, all of the module exhaust in the module exhaust conduit 240 may flow through the EPC 132 and thereby cool the hydrogen product.

Figure 6:
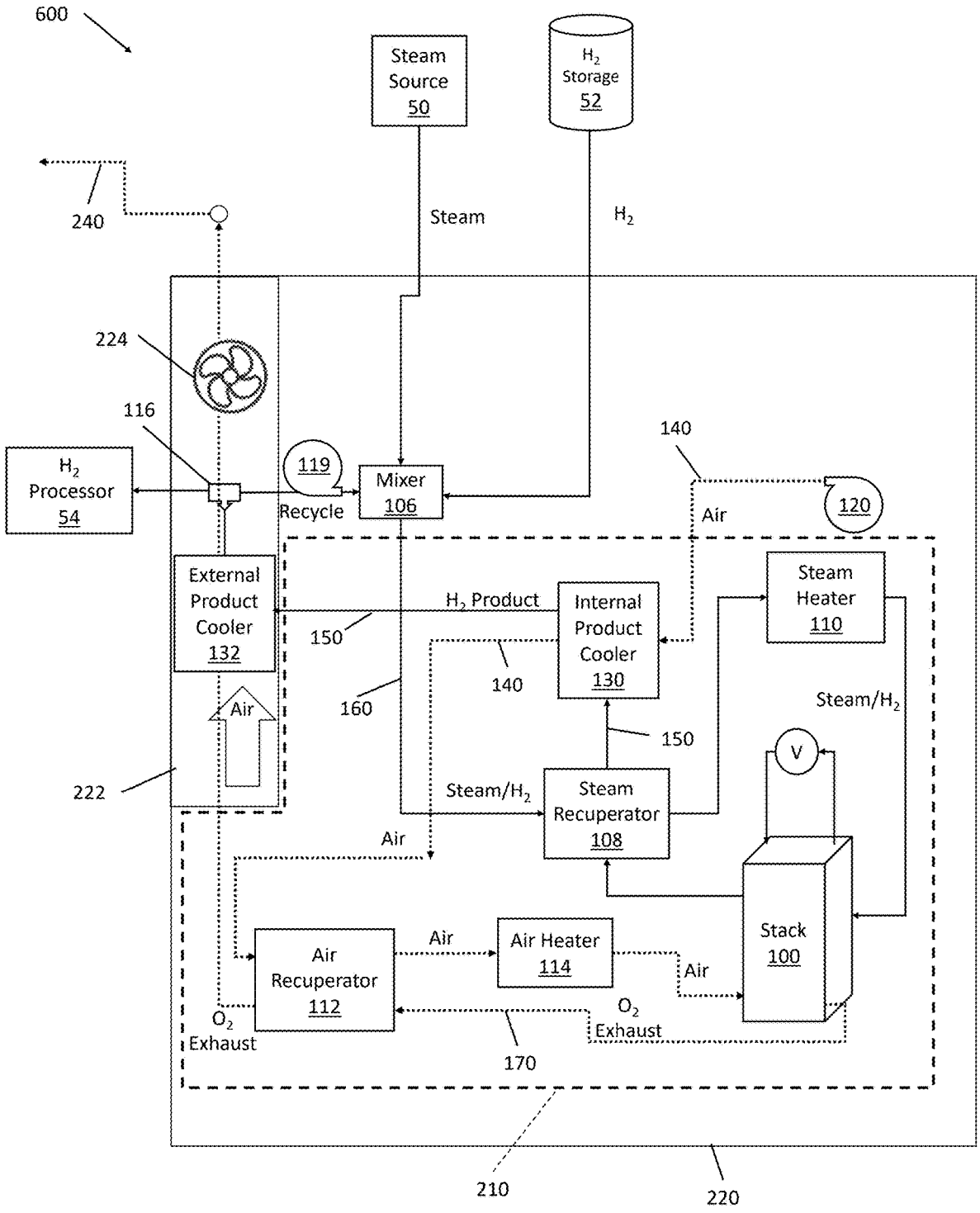

FIG. 6 is a schematic view of an electrolyzer module 600, according to various embodiments of the present disclosure. The module 600 may be similar to the module 200. As such, only the differences therebetween will be discussed in detail.

Referring to FIG. 6, the EPC 132 may be located within the ventilation unit (e.g., ventilation duct) 222. The cabinet air drawn in the by the fan 224 may be used to cool the EPC 132. In some embodiments, the EPC 132 may be a radiator or finned tube heat exchanger configured to transfer heat to the cabinet air flowing around the heat exchanger. As such, the module 600 may omit the cooling air blower 122.

Figure 7:
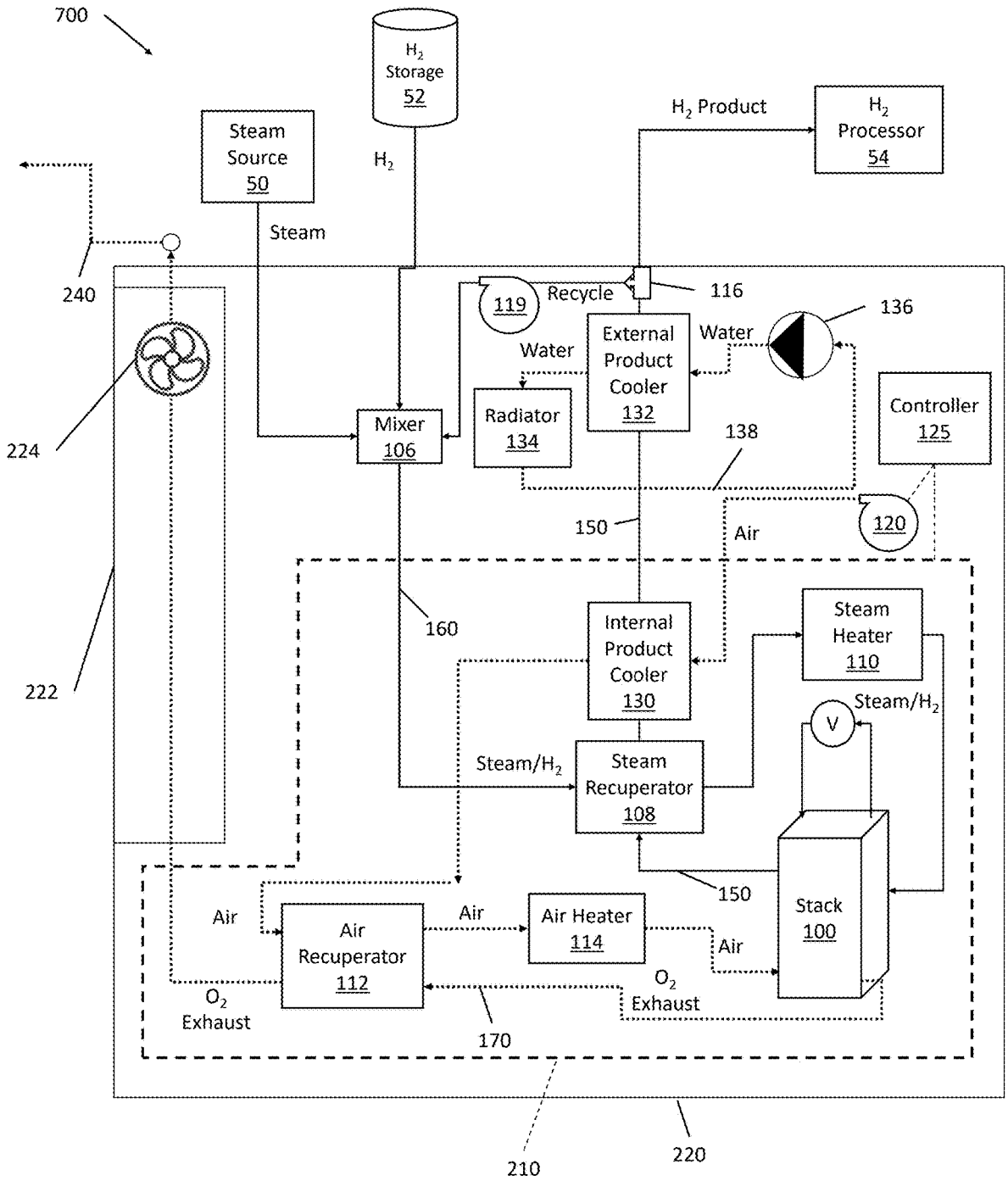

FIG. 7 is a schematic view of an electrolyzer module 700, according to various embodiments of the present disclosure. The module 700 may be similar to the module 200. As such, only the differences therebetween will be discussed in detail.

Referring to FIG. 7, the module 700 may include a liquid cooled EPC 132, a radiator 134, a pump 136 and a cooling liquid conduit assembly 138. The pump 136 may be configured to pump a cooling liquid, such as water, through cooling liquid conduit assembly 138 comprising one or more conduits that fluidly connect the EPC 132, the radiator 134, and the pump 136. In some embodiments, the cooling liquid conduit assembly 138 may be a closed circuit through which the cooling liquid is circulated. The radiator 134 may be configured to cool the heated cooling liquid output from the EPC 132 using cabinet air. The cooled liquid from the radiator 134 is then pumped by the pump 136 back into the EPC 132 through the cooling liquid conduit assembly 138. In an alternative embodiment, the radiator 134 may be located outside of the cabinet 220 to radiate heat to ambient air. In other embodiments, the radiator 134 may be cooled using a dedicated air blower.

Figure 8:
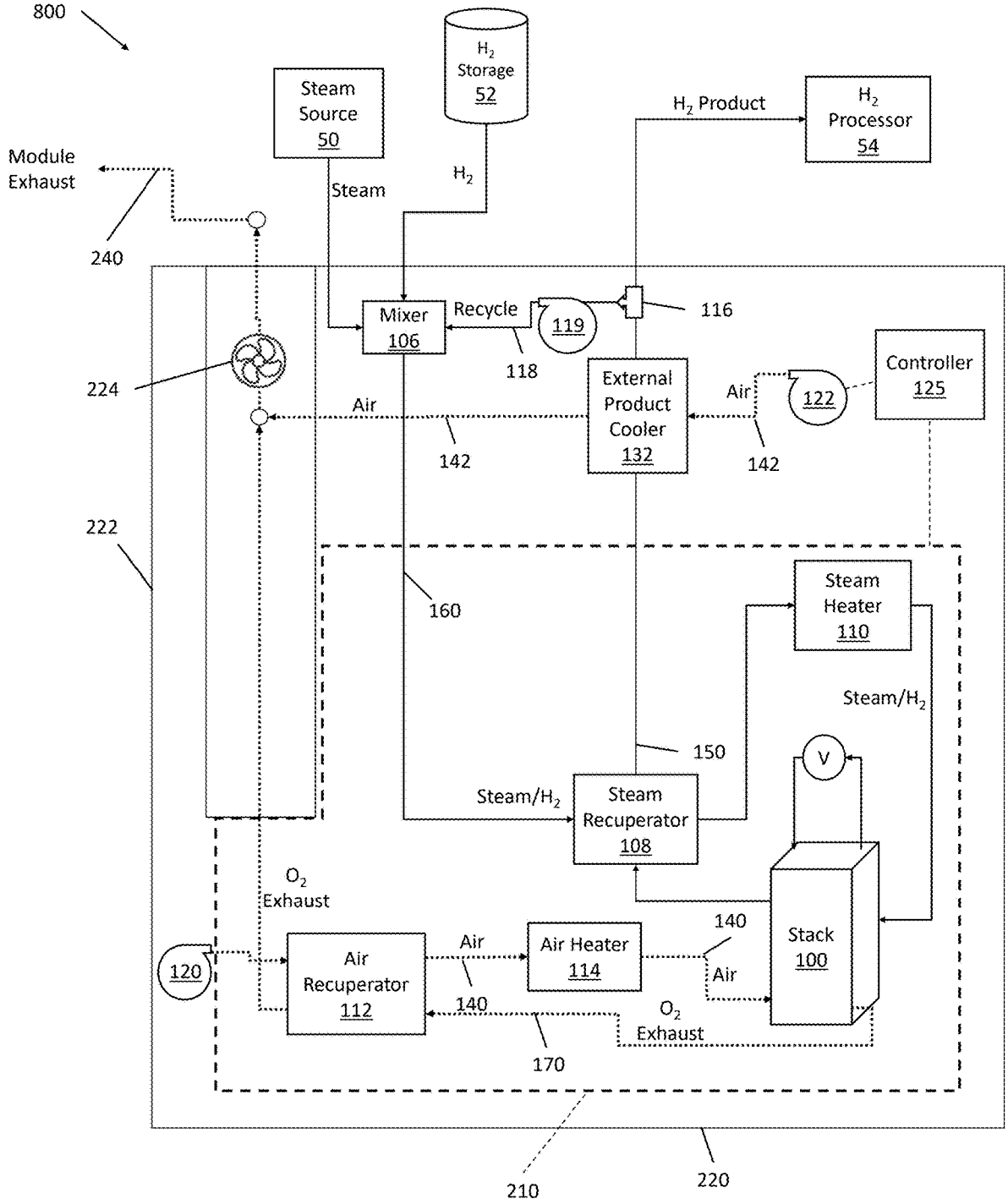

FIG. 8 is a schematic view of an electrolyzer module 800, according to various embodiments of the present disclosure. The module 800 may be similar to the module 200. As such, only the differences therebetween will be discussed in detail.

Referring to FIG. 8, the module 800 may include the EPC 132 but may omit the IPC 130. The EPC 132 may be fluidly connected to the cooling air blower 122 and may be sufficient to cool the hydrogen product to a temperature of 200° C. or less, such as a temperature ranging from about 130° C. to about 160° C.

Figure 9:
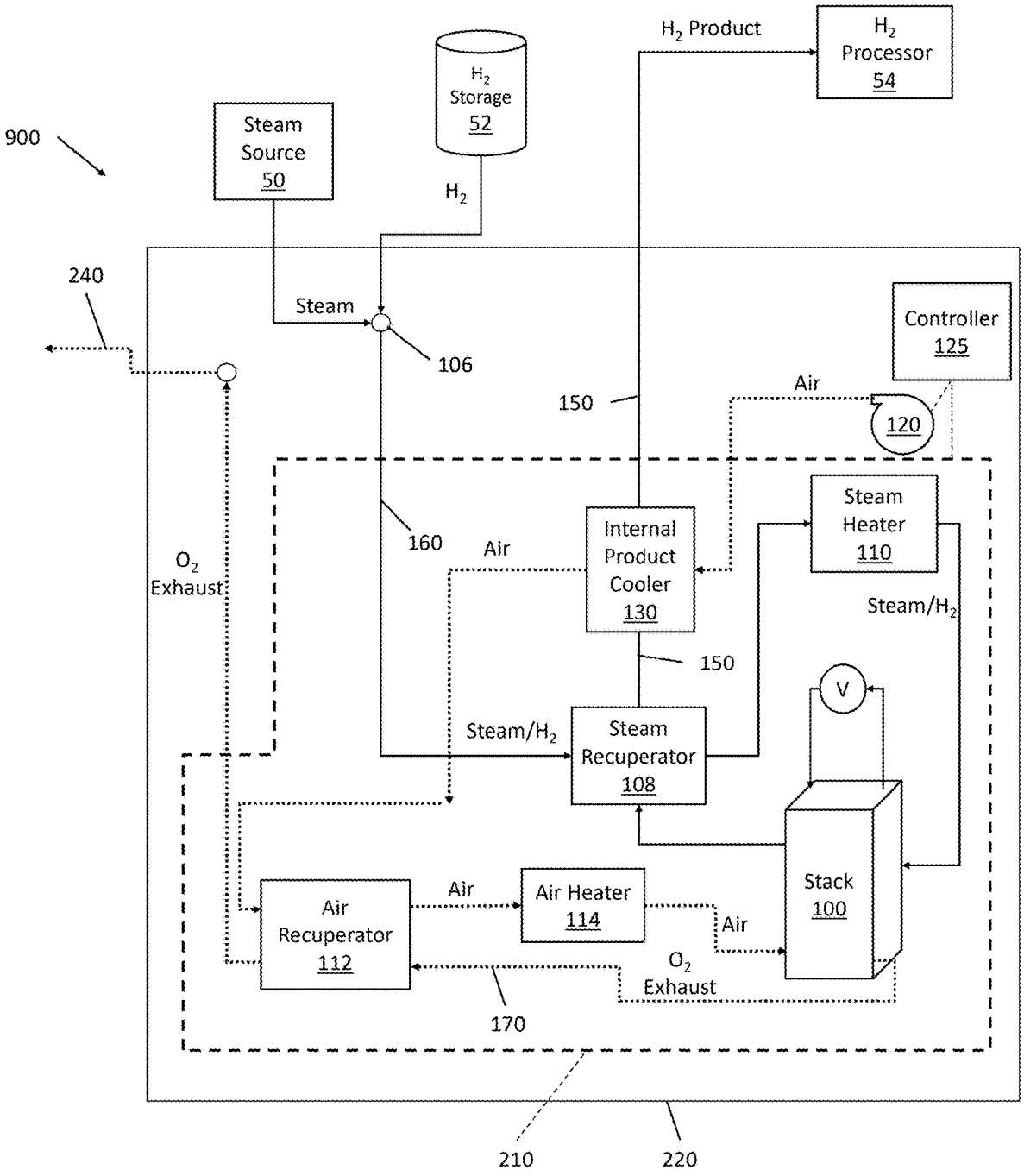

FIG. 9 is a schematic view of an electrolyzer module 900, according to various embodiments of the present disclosure. The module 900 may be similar to the module 200. As such, only the differences therebetween will be discussed in detail.

Referring to FIG. 9, the module 900 may include the IPC 130 but may omit the EPC 132, the cooling air blower 122, the hydrogen separator 116, the recycle conduit 118 and the recycle blower 119. Since the hydrogen product is not recycled, all of the hydrogen product may be provided to the hydrogen processor 54. In case the hydrogen processor 54 is rated for higher temperature operation than the recycle blower 119, the hydrogen product may be output from the IPC 130 at a higher temperature without the need for the EPC to further lower the temperature of the hydrogen product to meet the lower temperature rating of the recycle blower 119.

Figure 10:
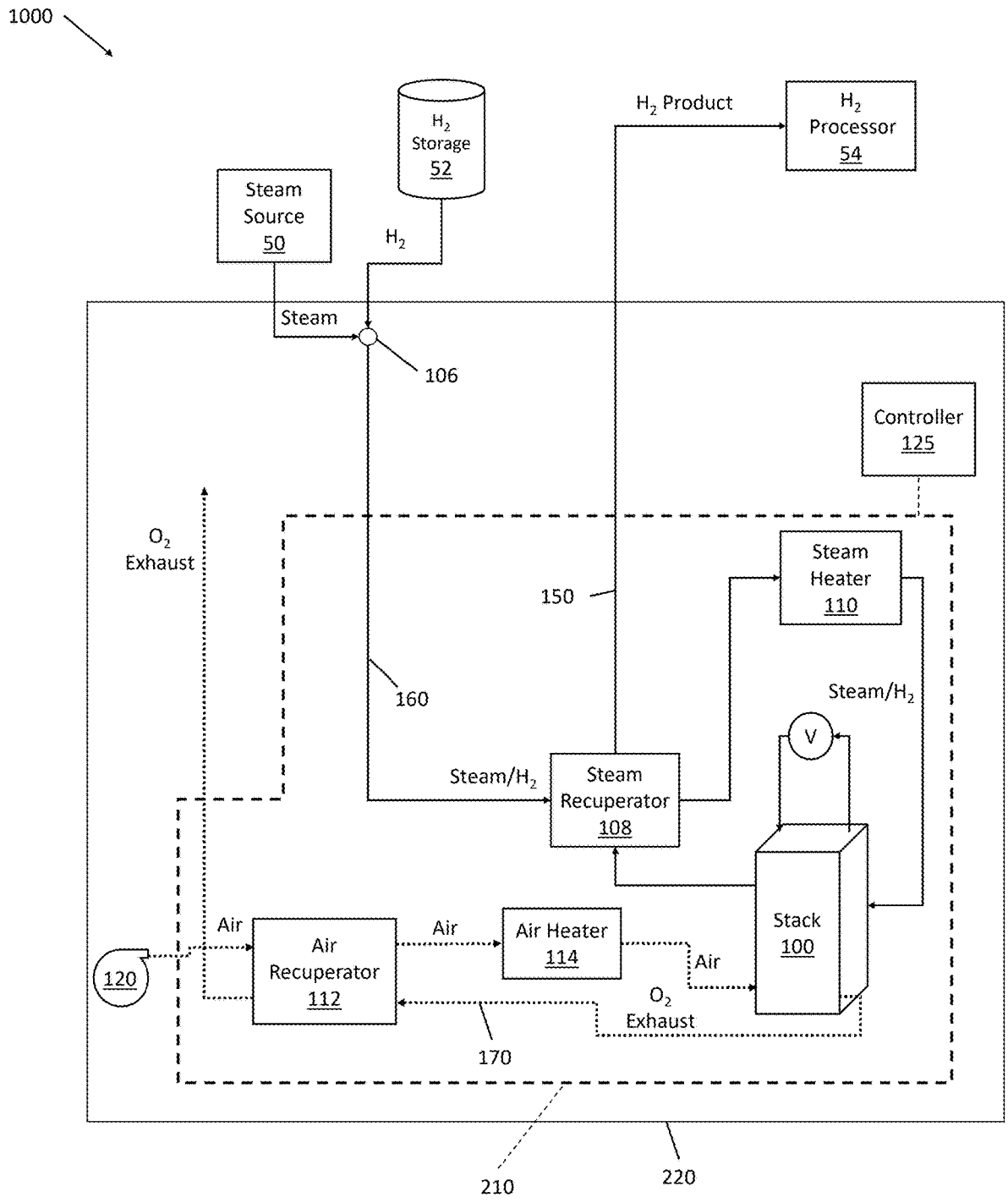

FIG. 10 is a schematic view of an electrolyzer module 1000, according to various embodiments of the present disclosure. The module 1000 may be similar to the module 200. As such, only the differences therebetween will be discussed in detail.

Referring to FIG. 10, the module 1000 may omit the IPC 130, the EPC 132, the cooling air blower 122, the hydrogen separator 116, the recycle conduit 118 and the recycle blower 119. In particular, if the hydrogen processor 54 is a high temperature operation rated processor, the module 1000 may be simplified by omitting both the IPC 130 and the EPC 132 since there is no recycling of the hydrogen product to the recycle blower 119.

Figure 11A:
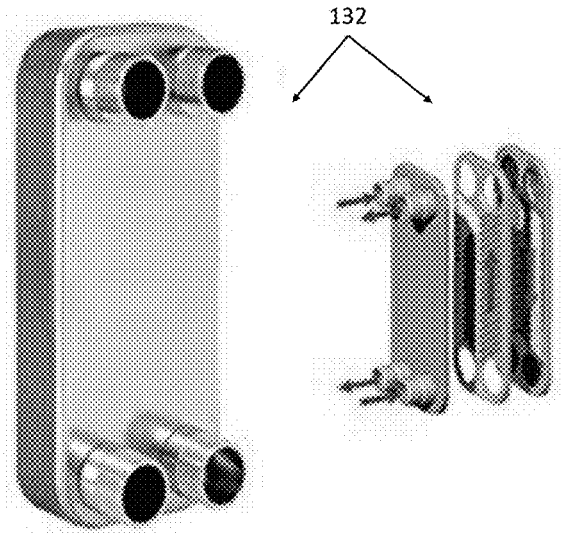
FIGS. 11A-11E illustrate various heat exchangers that may be utilized in the electrolyzer modules of various embodiments of the present disclosure.
Figure 11B:
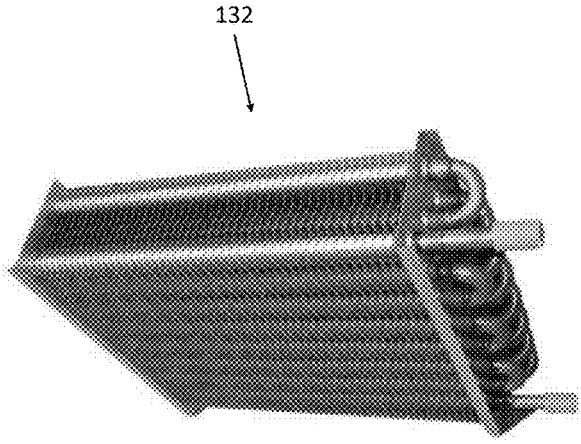
Figure 11C:
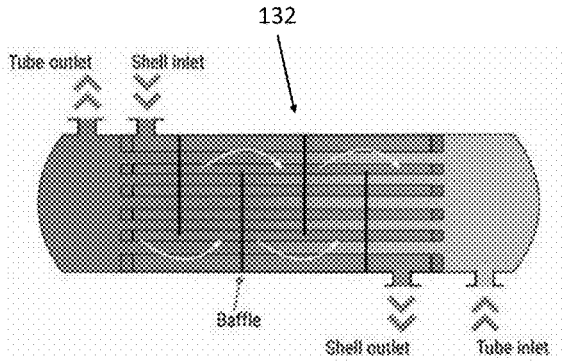
Figure 11D:
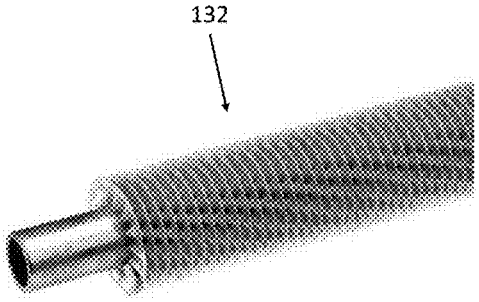
Figure 11E:
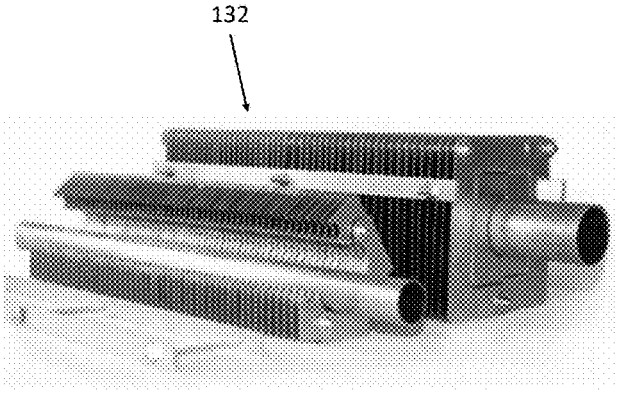

FIGS. 11A-11E illustrate various heat exchangers that may be utilized in the electrolyzer modules of various embodiments. In particular, the heat exchangers may be utilized as the EPC 132 described above. For example, FIG. 11A shows a brazed plate heat exchanger EPC 132, FIG. 11B shows a radiator heat exchanger EPC 132, FIG. 11C shows a shell and tube heat exchanger EPC 132, FIG. 11D shown a finned tube heat exchanger EPC 132, and FIG. 11E shown a finned tube clamp heat exchanger EPC 132.

Electrolyzer systems of various embodiments of the present disclosure provide a benefit to the climate by reducing greenhouse gas emissions and/or generating carbon-free fuel.

It will be apparent to those skilled in the art that various modifications and variations can be made in the architecture for hotbox simplification by way of a secondary product cooler or alternatively elimination of a recycle loop of the present invention without departing from the spirit or scope of the invention. Thus, it is intended that the present invention cover the modifications and variations of this invention provided they come within the scope of the appended claims and their equivalents.

The invention claimed is:

1. An electrolyzer module, comprising:

a cabinet;

a hotbox located in the cabinet;

a stack of electrolyzer cells located in the hotbox and configured receive a first air stream and steam, and output a product stream comprising hydrogen and steam, and an oxygen exhaust stream;

an internal product cooler (IPC) heat exchanger located in the hotbox and configured to reduce a temperature of the product stream by transferring heat to the first air stream;

an external product cooler (EPC) heat exchanger located inside of the cabinet and outside of the hotbox, and configured to further reduce the temperature of the product stream by transferring heat to a fluid stream; and a main air blower configured to generate the first air stream.

2. The electrolyzer module of claim 1, further comprising:

a first air conduit assembly fluidly connecting the main air blower to the stack;

a cooling air blower configured to generate a second air stream, wherein the fluid stream comprises the second air stream; and a second air conduit assembly fluidly connecting the cooling air blower to the EPC.

3. The electrolyzer module of claim 2, further comprising a controller configured to control operation of the main air blower and the cooling air blower based on an amount of oxygen being generated in the stack and a temperature of the product stream output from the EPC, respectively.

4. The electrolyzer module of claim 1, wherein the main air blower is also configured to generate a second air stream, and the fluid stream comprises the second air stream.

5. The electrolyzer module of claim 4, further comprising:

a first air conduit assembly fluidly connecting the main air blower to the stack;

a second air conduit assembly fluidly connecting the main air blower to the EPC;

at least one air valve located on at least one of the first air conduit assembly or the second air conduit assembly, and configured to control a flow rate of at least one of the first and the second air streams; and a controller configured to control the at least one air valve based on an amount of oxygen being generated in the stack and a temperature of the product stream output from the EPC.

6. The electrolyzer module of claim 1, further comprising:

a module exhaust conduit configured to receive a module exhaust from the cabinet; and a cabinet ventilation unit configured to mix the oxygen exhaust stream and a cabinet exhaust to form the module exhaust, and to provide the module exhaust to the module exhaust conduit, wherein the fluid stream comprises at least a portion of the module exhaust.

7. The electrolyzer module of claim 6, further comprising a product conduit assembly configured to provide all of the product stream output from the EPC to a hydrogen processor.

8. The electrolyzer module of claim 6, further comprising:

a diversion conduit fluidly connecting the EPC to the module exhaust conduit and configured to receive a portion of the module exhaust; and an air valve located on the diversion conduit and configured to control a flow rate of the module exhaust through the diversion conduit to the EPC.

9. The electrolyzer module of claim 6, wherein the EPC is directly connected to the module exhaust conduit and receives all of the module exhaust.

10. The electrolyzer module of claim 9, wherein the EPC is located within the ventilation unit.

11. The electrolyzer module of claim 1, further comprising:

a radiator;

a pump; and a cooling fluid conduit assembly configured to fluidly connect the radiator, the pump, and the EPC, wherein:

the fluid stream comprises water;

the pump is configured to circulate the water through the cooling fluid conduit assembly; and the radiator is configured to cool the water.

12. The electrolyzer module of claim 1, further comprising:

a product conduit assembly configured to provide a first portion of the product stream output from the EPC to a hydrogen processor;

a hydrogen separator configured to divert a second portion of the product stream output from the EPC into the product conduit assembly;

a recycle conduit fluidly connected to the hydrogen separator;

a recycle blower located on the recycle conduit and configured to provide the second portion of the product stream from the hydrogen separator through the recycle conduit into the stack;

an air recuperator heat exchanger located in the hotbox and configured to receive the first air stream from the IPC and to heat the first air stream using the oxygen exhaust stream; and an air heater located in the hotbox and configured to receive the first air stream from the air recuperator heat exchanger and to heat the first air stream before the first air stream is provided to the stack.

13. The electrolyzer module of claim 1, wherein:

the stack of electrolyzer cells comprises a stack of solid oxide electrolyzer cells; and the EPC comprises a brazed plate heat exchanger, a radiator heat exchanger, a shell and tube heat exchanger, a finned tube heat exchanger, or a finned tube clamp heat exchanger.

14. A method of operating an electrolyzer module, comprising:

providing a first air stream and steam into a stack of electrolyzer cells located in a hotbox and outputting a product stream comprising hydrogen and steam, and an oxygen exhaust stream;

providing the product stream to an internal product cooler (IPC) heat exchanger located in the hotbox to reduce the temperature of the product stream by transferring heat to the first air stream; and providing the product stream from the IPC to an external product cooler (EPC) heat exchanger located outside of the hotbox and inside of a cabinet housing the hotbox to further reduce the temperature of the product stream by transferring heat to a fluid stream.

15. The method of claim 14, wherein:

the first air stream is provided to the stack by a main air blower;

the fluid stream is a second air stream provided to the EPC by a cooling air blower; and the main air blower and the cooling air blower are controlled based on an amount of oxygen being generated in the stack and a temperature of the product stream output from the EPC, respectively.

16. The method of claim 14, wherein:

the first air stream is provided to the stack by a main air blower;

the fluid stream is a second air stream provided to the EPC by the main air blower; and at least one valve located downstream of the main air blower is controlled based on an amount of oxygen being generated in the stack and a temperature of the product stream output from the EPC, respectively.

17. The method of claim 14, further comprising:

a module exhaust conduit which receives a module exhaust from the cabinet; and a cabinet ventilation unit which mixes the oxygen exhaust stream and a cabinet exhaust to form the module exhaust, and provides the module exhaust to the module exhaust conduit, wherein the fluid stream comprises at least a portion of the module exhaust.

18. The method of claim 14, further comprising:

circulating the fluid stream which comprises water through a cooling fluid conduit assembly between the EPC and a radiator;

cooling the water in the radiator; and heating the water in the EPC.

19. The method of claim 14, wherein the product stream is output from the EPC at a temperature below 200° C.

20. An electrolyzer module, comprising:

a hotbox;

a stack of electrolyzer cells located in the hotbox and configured receive a first air stream and steam, and output a product stream comprising hydrogen and steam, and an oxygen exhaust stream;

a main air blower configured to generate the first air stream;

a first air conduit assembly fluidly connecting the main air blower to the stack;

a cooling air blower configured to generate a second air stream;

an external product cooler (EPC) heat exchanger located outside of the hotbox and configured reduce a temperature of the product stream by transferring heat to the second air stream; and a second air conduit assembly fluidly connecting the cooling air blower to the EPC.

* * * * *